US010396498B2

(12) United States Patent
Gassner

(10) Patent No.: US 10,396,498 B2
(45) Date of Patent: Aug. 27, 2019

(54) POWER ADAPTER

(71) Applicant: LIMOSS (SHENZHEN) CO., LTD., Shenzhen (CN)

(72) Inventor: Christian Gassner, Shenzhen (CN)

(73) Assignee: LIMOSS (SHENZHEN) CO., LTD, Shenzhen (CN)

( * ) Notice: Subject to any disclaimer, the term of this patent is extended or adjusted under 35 U.S.C. 154(b) by 0 days.

(21) Appl. No.: 15/580,634

(22) PCT Filed: Mar. 31, 2017

(86) PCT No.: PCT/CN2017/079095

§ 371 (c)(1),
(2) Date: Dec. 7, 2017

(87) PCT Pub. No.: WO2018/176403

PCT Pub. Date: Oct. 4, 2018

(65) Prior Publication Data

US 2018/0366877 A1 Dec. 20, 2018

(51) Int. Cl.
*H01R 13/62* (2006.01)
*H01R 13/639* (2006.01)
(Continued)

(52) U.S. Cl.
CPC ..... *H01R 13/6395* (2013.01); *H01R 13/44* (2013.01); *H01R 13/627* (2013.01);
(Continued)

(58) Field of Classification Search
None
See application file for complete search history.

(56) References Cited

U.S. PATENT DOCUMENTS 4,662,697 A 5/1987 Moses
5,919,055 A * 7/1999 Hattori ..... H01R 13/62938 439/310
(Continued)

FOREIGN PATENT DOCUMENTS

CN 2170587 Y 6/1994
CN 2838078 Y 11/2006
(Continued)

OTHER PUBLICATIONS

International Search Report dated Dec. 25, 2017, for corresponding International Application PCT/CN2017/079095, filed Mar. 31, 2017.

*Primary Examiner* — Xuong M Chung Trans
(74) *Attorney, Agent, or Firm* — Steven M. Koehler; Westman, Champlin & Koehler, P.A.

(57) ABSTRACT

A power adapter, comprising an adapter body, a power cord and a snap-fitting cover, the adapter body is provided with a socket, the power cord is provided with a plug plugged in and connected with the socket, and the snap-fitting cover includes the snap-fitting portion and the fixing portion, the fixing portion is movably connected to the end of the adapter body, the snap-fitting portion is provided with a groove which is shapely matched with the plug, and a groove is snap-fitted to the outer side of the plug. The snap-fitting cover is connected with the plug and the adapter body at the same time to retain the plug and the adapter body, and the plug is not easily disengaged from the socket of the adapter body under the external forces, thereby making the use of the power adapter more stable and reliable.

13 Claims, 8 Drawing Sheets

(51) Int. Cl.

| | |
|---|---|
| ***H01R 13/44*** | (2006.01) |
| ***H01R 13/64*** | (2006.01) |
| ***H01R 13/627*** | (2006.01) |
| ***H01R 13/74*** | (2006.01) |
| ***H01R 24/20*** | (2011.01) |
| *H01R 103/00* | (2006.01) |
| *H01R 31/06* | (2006.01) |

(52) U.S. Cl.
CPC ..... *H01R 13/6392* (2013.01); *H01R 13/64* (2013.01); *H01R 13/741* (2013.01); *H01R 24/20* (2013.01); *H01R 31/06* (2013.01); *H01R 31/065* (2013.01); *H01R 2103/00* (2013.01)

(56) References Cited

U.S. PATENT DOCUMENTS 7,804,691 B1 * 9/2010 Davis ..... H05K 5/0247 361/752
7,837,500 B2 * 11/2010 Chen ..... H01R 13/748 439/564

FOREIGN PATENT DOCUMENTS

CN 200941490 Y 8/2007
CN 202308605 U 7/2012

* cited by examiner

POWER ADAPTER

TECHNICAL FIELD

The present application relates to the technical field of electronic products, and more particularly relates to a power adapter.

BACKGROUND

The adapter body is a power supply conversion equipment for small portable electronic equipment and the electronic appliances, the adapter body, also known as external power supply, is often used in notebook computers, LCD monitors, mobile phones and other small electronic products. The adapter body is generally composed of shell, transformer, inductance, capacitance, control IC, PCB board and other components, and its working principle is converting the AC inputting into DC outputting, which is generally configured with a power cord with a plug when used, the adapter body is electrically connected to the host or external receptacle through the power cord. However, the connection is realized only through the combination of the shaft and the hole when the power cord plug and the socket of the adapter body are connected in the actual using process, the plug can be disengaged from the socket easily due to a collision onto the power cord, resulting in the power outrage of electronic products, which will not only affect the normal work of electronic products, but also damage the electronic products to some certain extent, resulting in a poor using effect.

SUMMARY OF THE INVENTION

The application adopts the below technical scheme: a power adapter, comprises an adapter body and a power cord, one end of said adapter body is provided with a socket, one end of said power cord is provided with a plug, and said plug is plugged in and connected to said socket; wherein said power adapter further comprises a snap-fitting cover, said snap-fitting cover comprises a snap-fitting portion and a fixing portion connected to said snap-fitting portion, said fixing portion is movably connected to said end provided with the socket of the adapter body, said snap-fitting portion is provided with a groove whose one side is open and has a shape adapted to the contour of said plug, and said groove is snap-fitted to the outer side of said plug.

Said plug can comprise a straight portion and a trapezoidal portion provided in the longitudinal direction, said trapezoidal portion is connected with said power cord, said groove comprises a straight groove segment and a trapezoidal groove segment provided in the longitudinal direction, said straight groove is snap-fitted to said straight portion, and said trapezoidal groove segment is snap-fitted to said trapezoidal portion.

Each of the opposite inside walls in the transverse direction of said straight groove segment can be provided with an arcuate stop recess, and the opposite outside walls in the transverse direction of said straight portion are limited to said two arcuate stop recess respectively.

Each of the opposite inside walls in the transverse direction of said straight groove segment can be provided with an arcuate stop recess, and the opposite outside walls in the transverse direction of said straight portion are limited to the two arcuate stop recesses respectively.

Connecting slots and connecting columns can be arranged between said fixing portion and the end provided with a socket of the adapter body, and said fixing portion is movably connected to the end of said adapter body through the fit connection between said connecting slots and said connecting columns.

Said connecting slots can be provided in said fixing portion, and said connecting columns are provided at the end of said adapter body; or said connecting slots are provided at the end of said adapter body, and said connecting columns are provided in said fixing portion. Said connecting slots can be arranged to extend from the bottom surface of said fixing portion toward the top surface of said fixing portion; or said connecting slots are arranged to extend from the bottom surface of said adapter body to the top surface of said adapter body.

Said connecting slots and said connecting columns can be both arranged in the vertical direction.

Both the number of said connecting slots and the number of said connecting columns can be respectively two, and the fitted two connecting slots and two connecting columns are respectively located on both sides of said socket.

Each said connecting slot can comprise a transverse slot segment and a longitudinal slot segment connected to said transverse slot segment, the each said connecting column comprises a transverse column segment and a longitudinal column segment connected to said transverse column segment, said transverse slot segment is fittingly connected with said transverse column segment, and said longitudinal slot segment is fittingly connected with said longitudinal column segment.

Said two longitudinal slot segments can be respectively arranged to extend in the opposite directions from the two end of said two transverse slot segments, and said two longitudinal column segments are respectively arranged to extend in the opposite directions from the two end of said two transverse column segments.

The end of said fixing portion can be provided with a longitudinal guiding slot extending from the top surface of said fixing portion to the bottom surface of said fixing portion, the end of said adapter body located above said socket is provided with a longitudinal guide rib corresponding to the longitudinal guiding slot for sliding fit with said longitudinal guiding slot.

The bottom of said longitudinal stop slot can be provided with a longitudinal stop step for limiting the vertical sliding distance of said longitudinal guide rib relative to said longitudinal guiding slot.

Said snap-fitting portion and said fixing portion can be integrally injection-molded with ABS plastics.

The side of said adapter body is provided with a connection block which can be provided with at least one fixing hole for passing through the fasteners to be fixedly connected to the external device.

The advantageous effect of the present application is as follows: the power adapter of the present application is newly provided with a snap-fitting cover for ensuring that the plug is not easily disengaged from the adapter body, and the fixing portion of the snap-fitting cover and the end of the adapter body are movably connected, it is possible to ensure that the adapter body is always connected to the snap-fitting cover, when the plug is required to be pulled out, an external force is applied to move the snap-fitting cover firstly, but the snap-fitting cover will not be disconnected from the adapter body, and a certain space will is formed in the end of the adapter body for inserting the plug into the socket of the adapter body; when the plug is required to be re-plugged into the socket, an external force is firstly applied to the adapter body and the snap-fitting cover will be moved, but the snap-fitting cover will not be disconnected from the adapter body, and a certain space will be formed in the end of the adapter body for inserting the plug into the socket of said adapter; when the plug has been inserted into the socket, the groove provided on the snap-fitting portion will be snap-fitted to the outer side of the plug, since the groove is shapely matched with the contour of the plug, the snap-fitting portion of the snap-fitting cover can be stably connected with the plug, i.e., the connection between the fixing portion of the snap-fitting cover and the adapter body will be completed. Thus, the snap-fitting cover is respectively connected to the plug and the adapter body through the snap-fitting portion and the fixing portion, retaining the plug and the adapter body together, the plug will not be disengaged from the socket at the end of the adapter body under the action of external forces, it is possible to ensure the connection between the electronic products using the power adapter of the present application and the power supply more stable and reliable, with a better using effect.

BRIEF DESCRIPTION OF THE DRAWINGS

In order to make the technical solutions in the embodiments of the present application clearer, the accompanying drawings to be used in the embodiments and the description of the prior art will be briefly introduced below, it is apparent that the drawings in the following description are merely some embodiments of the present application and that other drawings may be obtained by those skilled in the field without departing from the inventive nature of the invention.

Figure 1:
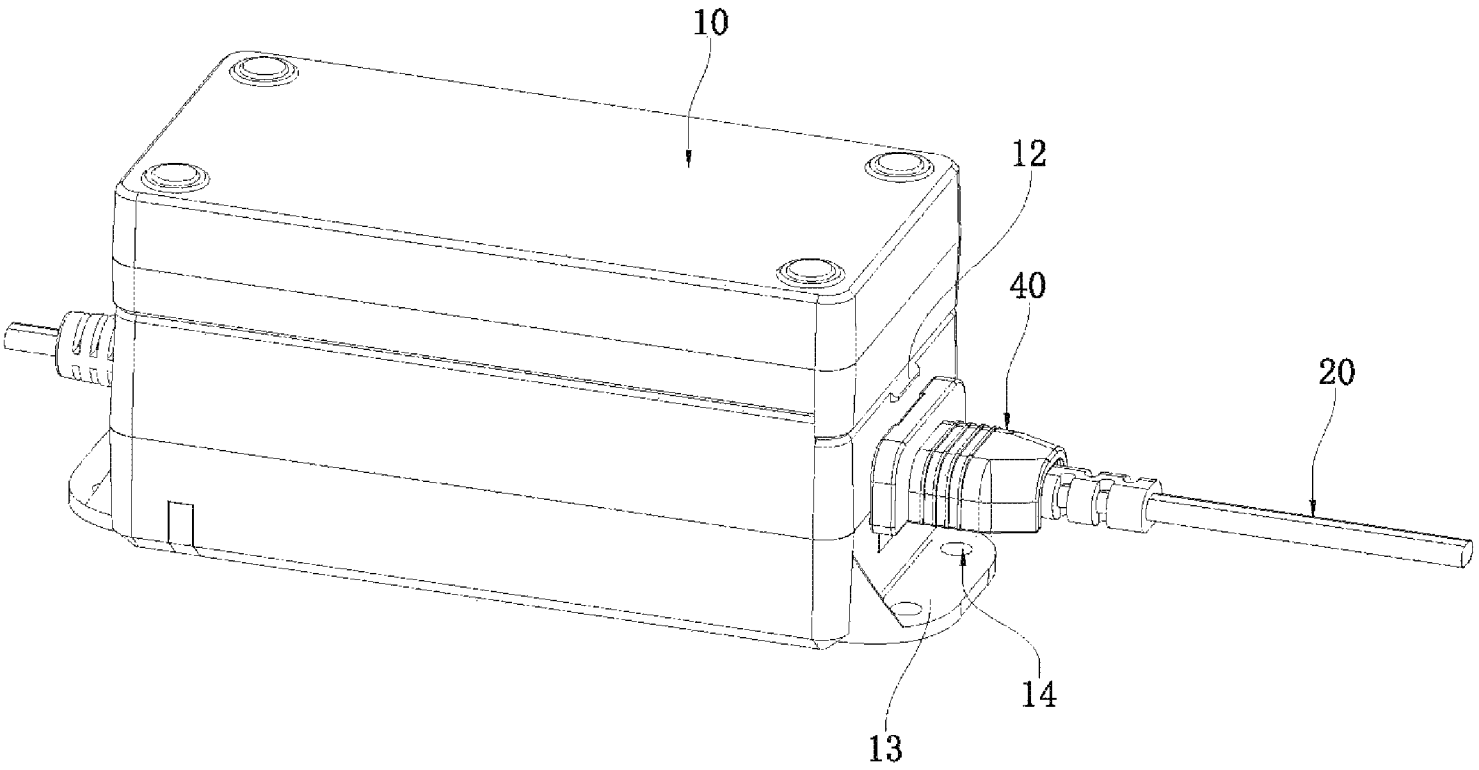
FIG. 1 is a structural schematic diagram of the power adapter according to an embodiment of the present application.
Figure 2:
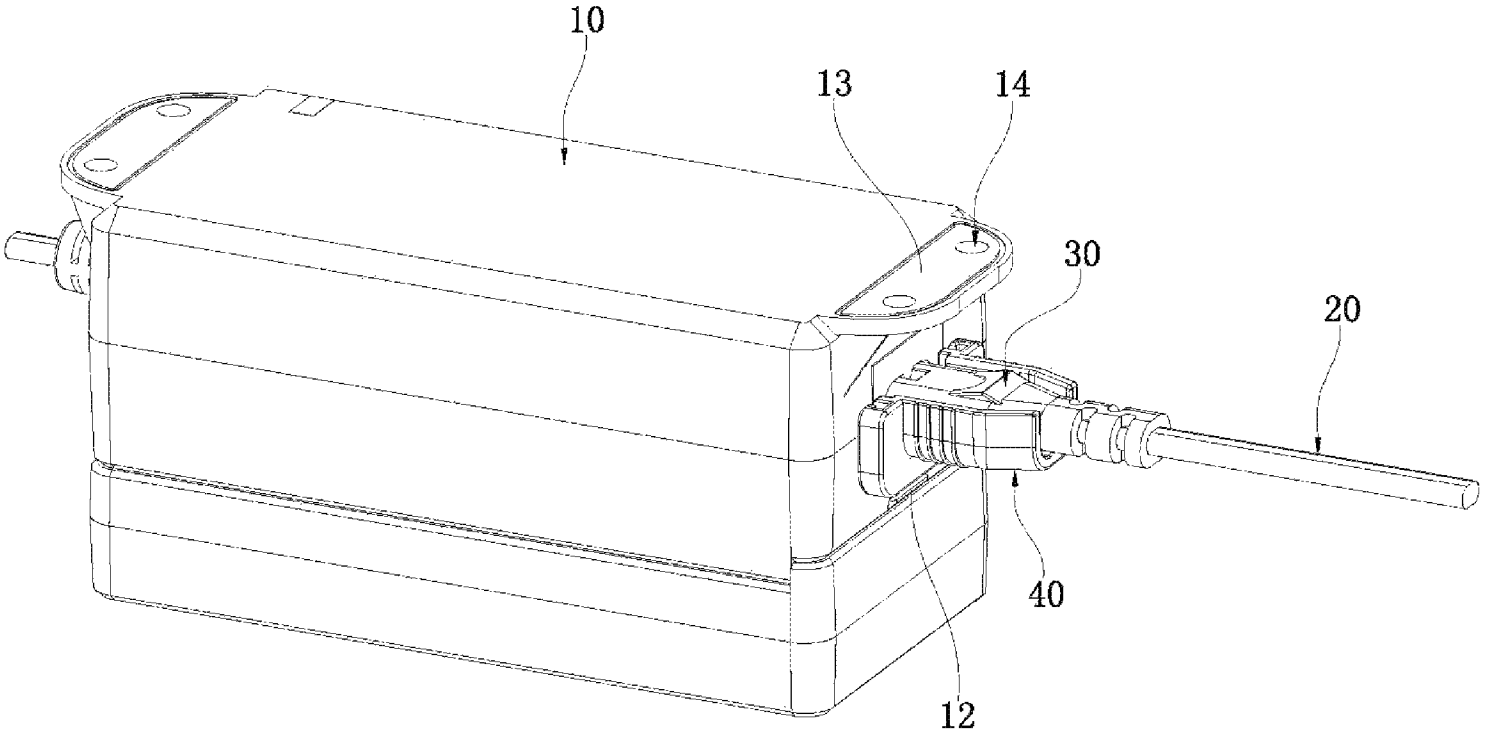
FIG. 2 is another structural schematic diagram of the power adapter according to an embodiment of the present application.

Among them, the drawings are marked as follows:

10 - Adapter Body; 11- Socket; 12 - Longitudinal Guide Rib;
13 - Connection block 14 - Fixing Hole; 20 - Power Cord; 30 - Plug;
31 - Straight Portion; 32 - Trapezoidal Portion; 40 - Snap-fitting Cover;
41 - Snap-fitting Portion; 42 - Fixing Portion; 50 - Connecting slot;
51 - Transverse Slot Segment; 52 - Longitudinal Slot Segment;
60 - Connecting column; 61 - Transverse Column Segment;
62 - Longitudinal Column Segment; 410 - Groove;
411 - Straight Groove Segment; 412 - Trapezoidal Groove Segment;
413 - Arcuate stop recess; 414 - Stop Protrusion;
421 - Longitudinal Guiding slot; 422 - Longitudinal Stop step.

DETAILED DESCRIPTION OF THE EMBODIMENT

The embodiment of the present application is described in detail below, and examples of said embodiments are shown in the drawings, where the same or similar labels represent the same or similar components or components having the same or similar functions. The embodiments described in the reference drawings 1-8 are illustrative, which are intended to be explain the present application and cannot be construed as limiting the present application.

In the description of the present application, "length", "width", "upper", "lower", "front", "back", "left" and "right", "vertical", "horizontal", "top", "bottom", "inside", "outside" and other terms indicating the orientation or positional relationship are based on orientation or positional relationship shown in the drawings, only for the purpose of facilitating the description of the invention and simplifying the description, instead of indicating or implying that the indicated device or component must have a specific orientation and constructed and operated in a particular orientation, and therefore it cannot be construed as limiting the invention.

In addition, the terms "first" and "second" are for illustrative purposes only and should not be construed as indicating or implying a relative importance or implicitly indicating the number of technical features indicated. Therefore, a feature that defines "first" and "second" may expressly or implicitly include one or more of the features. In the description of the present application, "multiple" means two or more than two, unless otherwise particularly defined.

In the present application, "install", "interconnect", "connect", "fix" and other terms should be understood in a broad sense, such as a fixed connection, a detachable connection, or an integrated connection; a mechanical connection or an electrical connection; or direct connection, indirect connection via the medium, or internal connections of the two elements or the interaction relationship of two elements. The specific meaning of the above terms in the present application could be understood by those ordinary skilled in the field according to specific circumstances.

As showed in FIGS. 1-8, a power adapter according to embodiment of the present application, comprises an adapter body 10 and a power cord 20, one end of the adapter body 10 is provided with a socket 11, one end of said power cord 20 is provided with a plug 30, and said plug 30 is plugged in and connected to said socket 11; said power adapter comprises the snap-fitting cover 40, said snap-fitting cover 40 comprises a snap-fitting portion 41 and a fixing portion 42 connected to said snap-fitting portion 41, said fixing portion 42 is movably connected to an end provided with a socket 11 of the adapter body 10, the snap-fitting portion 41 is provided with a groove 410 whose one side is open and has a shape matching with the contour of said plug 30, and said groove 410 is snap-fitted to the outer side of said plug 30.

Particularly, the power adapter of the present application is newly provided with a snap-fitting cover 40 for ensuring that the plug 30 is not easily disengaged from the adapter body 10, and the fixing portion 42 of the snap-fitting cover 40 and the end of the adapter body 10 are movably connected, it is possible to ensure that the adapter body 10 is always connected to the snap-fitting cover 40, when the plug 30 is required to be pulled out, a force can be applied to move the snap-fitting cover 30 firstly, but the snap-fitting cover 40 will not be disconnected from the adapter body 10, and a certain space will is formed in the end of the adapter body 10 for inserting the plug into the socket 11 of the adapter body 10; when the plug 30 is required to be connected to the socket 11, firstly, the snap-fitting cover 40 will be moved relative to the adapter body 10, at this time, the snap-fitting cover 40 will not be disconnected from the adapter body 10, and a certain space will be formed in the end of the adapter body 10 for inserting the plug 30 into the socket 11 of said adapter, when the plug has been inserted into the socket 11, the groove 410 provided on the snap-fitting portion 41 will be snap-fitted to the outer side of the plug 30, since the groove 410 is shapely matched with the plug 30, the snap-fitting portion 41 of the snap-fitting cover 40 can be connected with the plug 30 stably upon engagement, that is, the connection between the fixing portion 42 of the snap-fitting cover 40 and the adapter body 10 will be realized. Thus, the snap-fitting cover 40 is respectively connected to the plug 30 and the adapter body 10 through the snap-fitting portion 41 and the fixing portion 42, retaining the plug 30 and the adapter body 10 together, the plug 30 will not be disengaged from the socket 11 provided at the end portion of the adapter body 10 under the action of the external forces, it is possible to ensure the connection between the electronic products using the power adapter of the present application and the power supply more stable and reliable, with a better using effect. In addition, when it is required to pull the plug 30 out of the socket 11, since the fixing portion 42 of the snap-fitting cover 40 is movably connected to the end of the adapter body 10, the external forces can be applied to move the fixing portion 42 of the snap-fitting cover 40 towards the longitudinal guide rib 12 without disengagement from the adapter body 10, and the snap-fitting portion 41 snap-fitted to the plug 30 is further disengaged from the plug 30, so that the plug 30 can be pulled out of the socket 11, making it easy to repair or replace the power cord 20.

The power adapter according to the present embodiment can be applied to notebook computer, LCD, or mobile phone, or other small-sized electronic products.

The power adapter according to the present embodiment can also be applied to linear actuators, electric sofas, electric chairs, massage chairs, medical beds and other transmission devices.

Among them, the plug 30 is preferably an AC plug or a DC plug, and correspondingly, the socket is preferably an AC socket plugged with the AC plug or a DC socket plugged with the DC plug.

Further, the movably connection between the fixing portion 42 and the end provided with the socket 11 of the adapter body 10 particularly means that the fixing portion 42 and the adapter body 10 can be moved relative to each other, such as sliding relative to each other, so that a certain space could be formed through sliding for plugging the plug 30 into the socket 11. For example, the connection between the fixing portion 42 and the adapter body 10 may be achieved by means of an external connector, or the connection between the fixing portion 42 and the adapter body 10 may be achieved by a component molding on the fixing portion 42 or the adapter body 10. The object is that, when the fixing portion 42 is connected to the adapter body 10, the fixing portion 42 retains the adapter body 10, and the connection of the snap-fitting portion 41 with plug 30 retains the plug 30, which will enable the snap-fitting cover 40 to retain both the adapter body 10 and the plug 3, so that the connection between the plug 30 and the adapter body 10 is stabilized and not easily disengaged, ensuring the stability and reliability of the electrical connection between electronic products with the source adapter assembly, that is, to avoid the phenomenon of the electronics damage caused the instantaneous power failure.

Figure 3:
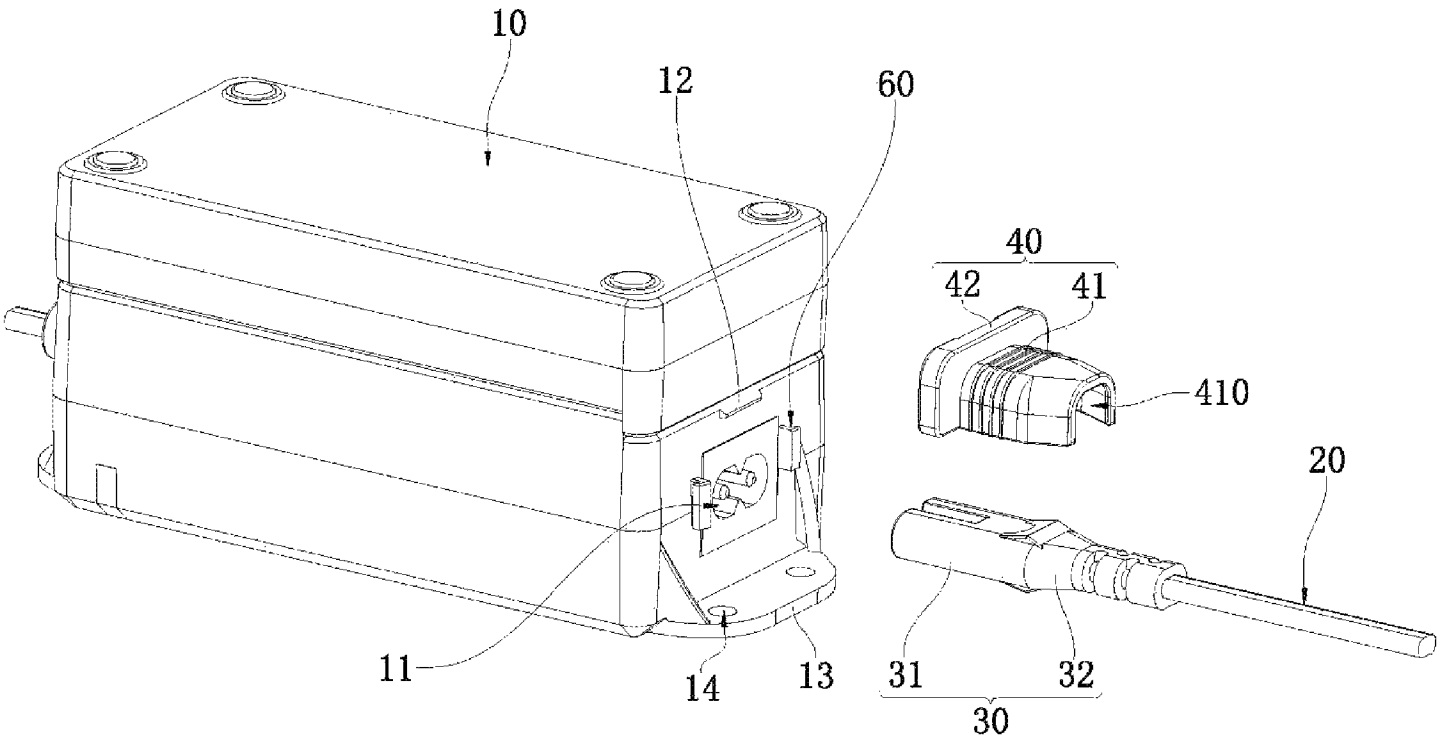
FIG. 3 is a structural decomposition schematic diagram of the power adapter according to an embodiment of the present application.
Figure 6:
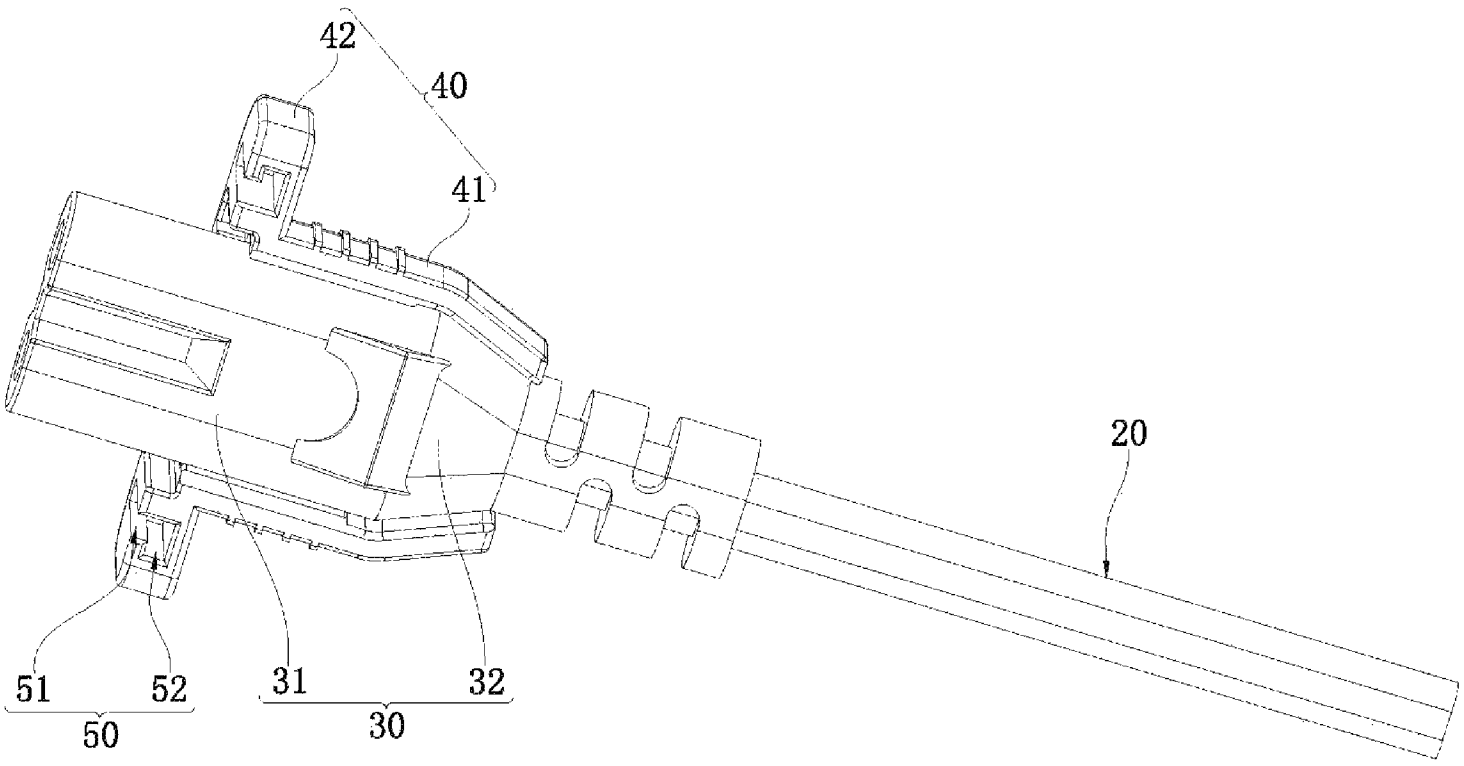
FIG. 6 is a structural schematic diagram of connection between the snap-fitting cover of the power adapter and the plug on the power cord according to an embodiment of the present application.

As shown in FIG. 3 and FIG. 6 according to the present embodiment, said plug 30 comprises a straight portion 31 and a trapezoidal portion 32 provided in the lengthwise direction, said trapezoidal portion 32 is connected with said power cord 20, and said groove 410 comprises a straight groove segment 411 and a trapezoidal groove segment 412 provided in the lengthwise direction, wherein the straight groove segment 411 and the trapezoidal groove segment 412 interconnect with each other and form said groove 410; said straight groove segment 411 is snap-fitted to said straight portion 31, and said trapezoidal groove segment 412 is snap-fitted to said trapezoidal portion 32. Particularly, a narrowed opening structure is formed in the end of the trapezoidal groove segment 412 adjacent to the power cord 20, and then when the straight groove segment 411 and the trapezoidal groove segment 412 are respectively snap-fitted to the straight portion 31 and the trapezoidal portion 32, the sliding of the snap-fitting cover 40 relative to the plug 30 in the lengthwise direction is limited by the trapezoidal groove segment 412 with a narrowed opening structure. Thus, it is possible to avoid a large displacement between the snap-fitting cover 40 and the plug 30 in the lengthwise direction, so that it is possible to ensure that the connection between the fixing portion 42 of the snap-fitting cover 40 and the adapter body 10 is more stable, and the retainment of the snap-fitting cover 40 to the plug 30 and the adapter body 10 is more effective, improving the stability and reliability of the connection between the power cord 20 and the adapter body 10.

Figure 7:
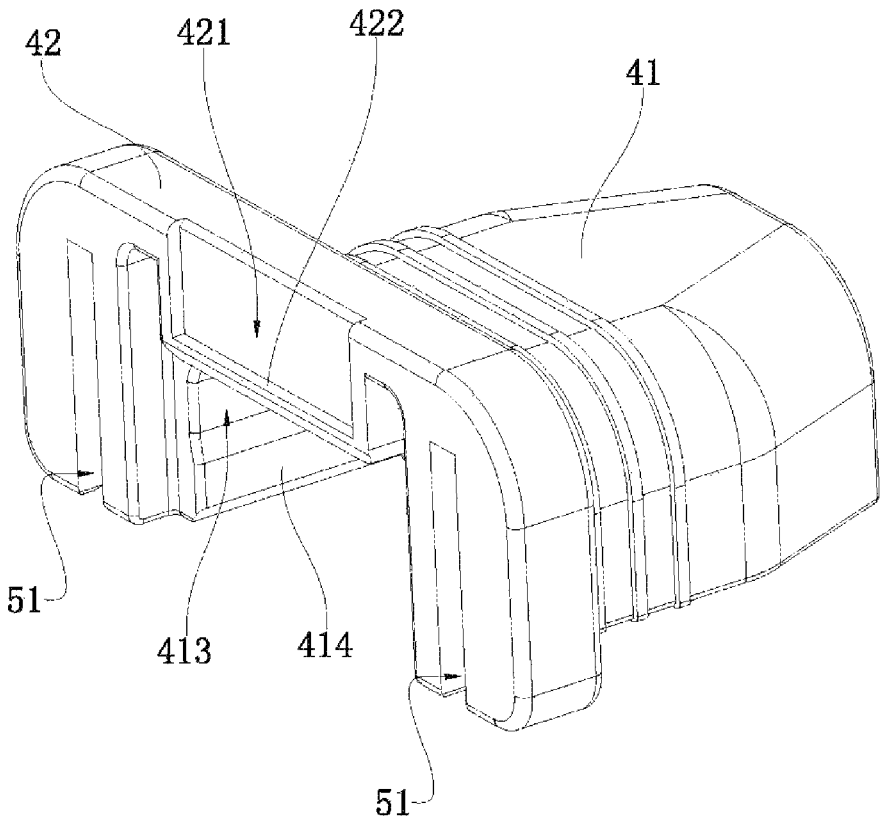
FIG. 7 is a structural schematic diagram of the snap-fitting cover of the power adapter according to an embodiment of the present application.
Figure 8:
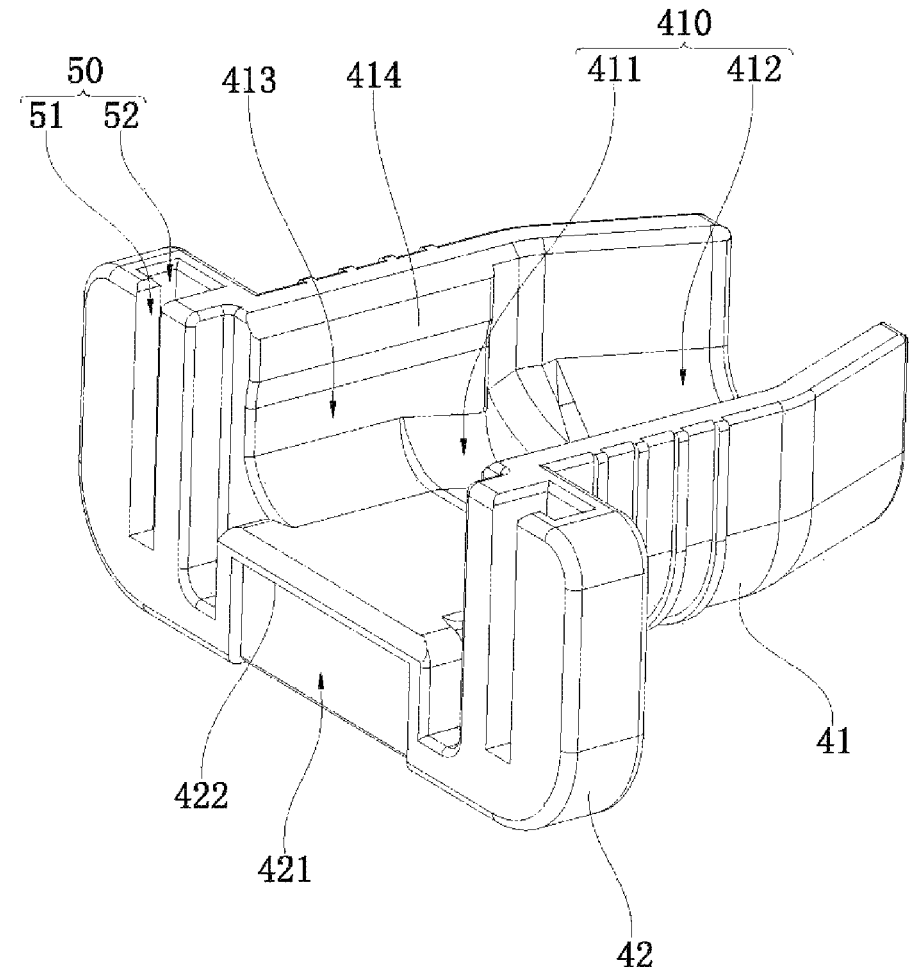
FIG. 8 is another structural schematic diagram of the snap-fitting cover of the power adapter according to the embodiment of the present application.

As shown in FIGS. 7~8 according to the present embodiment, each of the opposite inside walls in the transverse direction of said straight groove segment 411 is provided with an arcuate stop recess 413, and the opposite outside walls in the transverse direction of said straight portion 31 are respectively limited inside said two arcuate stop recess 413. Particularly, the arcuate stop recess 413 is concaved and formed in the inside wall of the straight groove segment 411, and when the straight portion 31 is accommodated in the straight groove segment 411, the opposite outside walls in the transverse direction of the straight portion 31 will be respectively accommodated in the concave structure of the arcuate stop recess 413, it is possible to further limit the straight portion 31, that is, enhancing the stability of the straight portion 31 in the straight groove segment 411, and the straight portion 31 cannot be driven out of the straight groove segment 411 under an ordinary external force.

Among them, as shown in FIG. 6, the opening of the groove 410 is slightly smaller than the plug 30 and the inside wall of the straight groove segment 411 of the groove 410 is provided with an arcuate stop recess 413 of the concave structure, so that the size of the straight groove segment 411 is adapted to the plug 30, and the snap-fitting cover 40 of the plug 30 will be yielded and snap-fitted to the plug 30 under the external forces, which can ensure that the plug 30 does not detached from the opening of the groove 410 easily. Further, the snap-fitting cover 40 is made of materials having a certain elasticity, which may fasten snap-fitting cover 40 and plug 30 more conveniently.

As shown in FIGS. 7~8 according to the present embodiment, each of the opposite inside walls in the transverse direction of said straight groove segment 411 is also provided with a stop protrusion 414 between the open edge at said groove 410 and said arcuate stop recess 413, the inner edge of said stop protrusion 414 abuts against said straight portion 31. Particularly, the stop protrusion 414 is formed at the edge of the opening of the groove 410, in other words, the stop protrusion 414 may further keep the straight portion 31 fastened inside the straight groove segment 411 from detaching from the straight groove segment 411, so as to keep the plug 30 from detaching from the groove 410, and to enhance the stability of the connection between snap-fitting cover 40 and the plug 30.

As shown in FIGS. 3~5 and 7~8 according to the present embodiment, the connecting slot 50 and the connecting columns 60 are arranged between said fixing portion 42 and the end provided with a socket 11 of said adapter body 10, said fixing portion 42 is movably connected to the end of said adapter body 10 through the fit connection of said connecting slot 50 and said connecting columns 60. Particularly, the connecting slot 50 and the connecting columns 60 may slid relative to each other, until they are fittingly connected completely with each other, so that the fixing portion 42 is connected to the end of the adapter body 10. The connecting columns 60 can be disengaged from the connecting slot 50 after sliding a certain distance relative to each other, so that the sliding of the snap-fitting cover 40 can be achieved, and then the movably connection of the fixing portion 42 and the end of the adapter body 10 can be realized, that is, the movably connection of the snap-fitting cover 40 and the adapter body 10 has been realized.

Among them, the connecting slots 50 and the connecting columns 60 have the same cross-sectional shape and are in the form of a long bar.

As shown in FIGS. 3~5 and 7~8 according to the present embodiment, said connecting slot is provided at said fixing portion 42, and said connecting columns 60 is provided at the end of said adapter body 10; or said connecting slot 50 is provided at the end of said adapter body 10, and said connecting column 60 is provided at said fixing portion 42. Particularly, the connection between the snap-fitting cover 40 and the end of the adapter body 10 will be realized as long as the fitting of the connecting slot 50 and the connecting columns 60 has been achieved. In other words, the connecting slot 50 can be provided at the fixing portion 42 as per the requirements of the structural design, i.e., the connecting slot 50 of concave structure can be formed at the exterior surface of the fixing portion 42, and the connecting columns 60 of protruded structure can be formed at the end of the adapter body 10 correspondingly. On the contrary, the connecting slot 50 may be provided at the end of the adapter body 10, that is, the connecting slot 50 of concave structure is formed on the outer surface of the end of the adapter body 10, and then the connecting columns 60 of protruded structure is formed at the outer surface of the fixing portion 42 correspondingly.

In summary, the connecting slot 50 and the connecting column 60 are arranged between the fixing portion 42 and the end of the adapter body 10, so as to achieve the movably connection between the fixing portion 42 and the adapter body 10 through the sliding fit between the connecting slot 50 and the connecting column 60.

Among then, the connecting slot 50 and the connecting column 60 have the same cross-sectional shape, preferably in the special-shaped structure, such that the fitted connecting slot 50 and the connecting columns 60 cannot be disengaged in a direction other than relative sliding, thus ensuring that the connecting slot 50 and the connecting columns 60 can be disconnected only in the relative sliding direction. And it is possible to ensure the connecting slot 50 and the connecting columns 60 are not disengaged from each other in the case of non-manual operation.

In the present embodiment, said connecting slot 50 extends from the bottom surface of said fixing portion 42 toward the top surface of said fixing portion 42; or said connecting slot 50 extends from the bottom surface of said adapter body 10 to the top surface of said adapter body 10. Particularly, that is, when the connecting slot 50 is located at the fixing portion 42, the upper end or lower end of the connecting slot 50 is provided with an opening, and the upper and lower ends are not provided with an opening structure at the same time, it is possible to ensure that the slide column 60 will not slide away directly along the top end to the bottom end of the fixing portion 42 or directly along the bottom end to the top end of the fixing portion 42 when the connecting column 60 slides into the connecting slot 50. Similarly, when the connecting slot 50 is located on the adapter body 10, the connecting slot 50 only has an upper or lower opening, and the upper and lower ends are not provided with an opening structure at the same time, it is possible to ensure that the slide column 60 will not slide away directly along the top end to the bottom end of the adapter body 10 or directly along the bottom end to the top end of the adapter body 10 when the connecting columns 60 slides into the connecting slot 50.

In the present embodiment, both said connecting slot 50 and said connecting column 60 are arranged in a vertical direction. Particularly, the vertical arrangement of the connecting slot 50 and the connecting columns 60 are favorable for assembling the connecting slot 50 and the connecting columns 60, the connecting slot 50 is aligned with the connecting columns 60 from the upper or lower direction in the process of assembly, and then the fit connection between the connecting slot 50 and the connecting columns 60 can be achieved by applying the upward or downward forces, thus the operation is convenient, efficient and practical.

Figure 4:
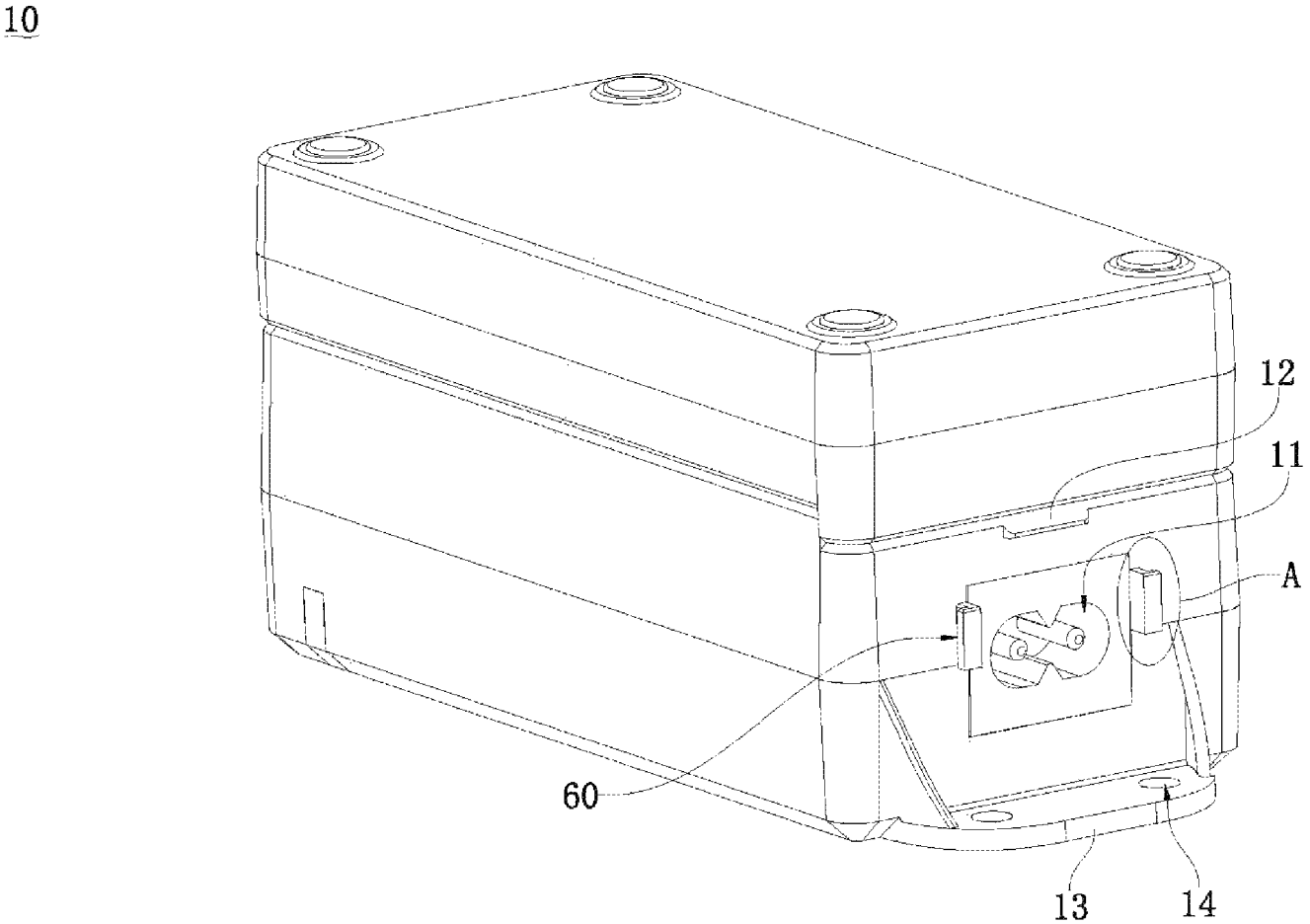
FIG. 4 is a structural schematic diagram of the adapter body of the power adapter according to an embodiment of the present application.

As shown in FIGS. 4 and 7 according to the present embodiment, both the number of said connecting slot 50 and the number of said connecting column 60 are respectively two, and the fitted two connecting slots 50 and said two connecting columns 60 are respectively located on both sides of said socket 11. Particularly, the assembled two connecting slots 50 and two connecting columns 60 are respectively at both sides of the socket 11, since the plug 30 is plugged in and connected to the socket 11, such that both sides of the fitted socket 11 and the plug 30 are respectively provided with the fitted connecting slots 50 and the connecting columns 60 to enhance the connection between the socket 11 and the plug 30, ensuring that the connection between the socket 11 and the plug 30 is not easily disengaged, and the stability and reliability of the connection between the socket 11 and the plug 30 is improved.

Figure 5:
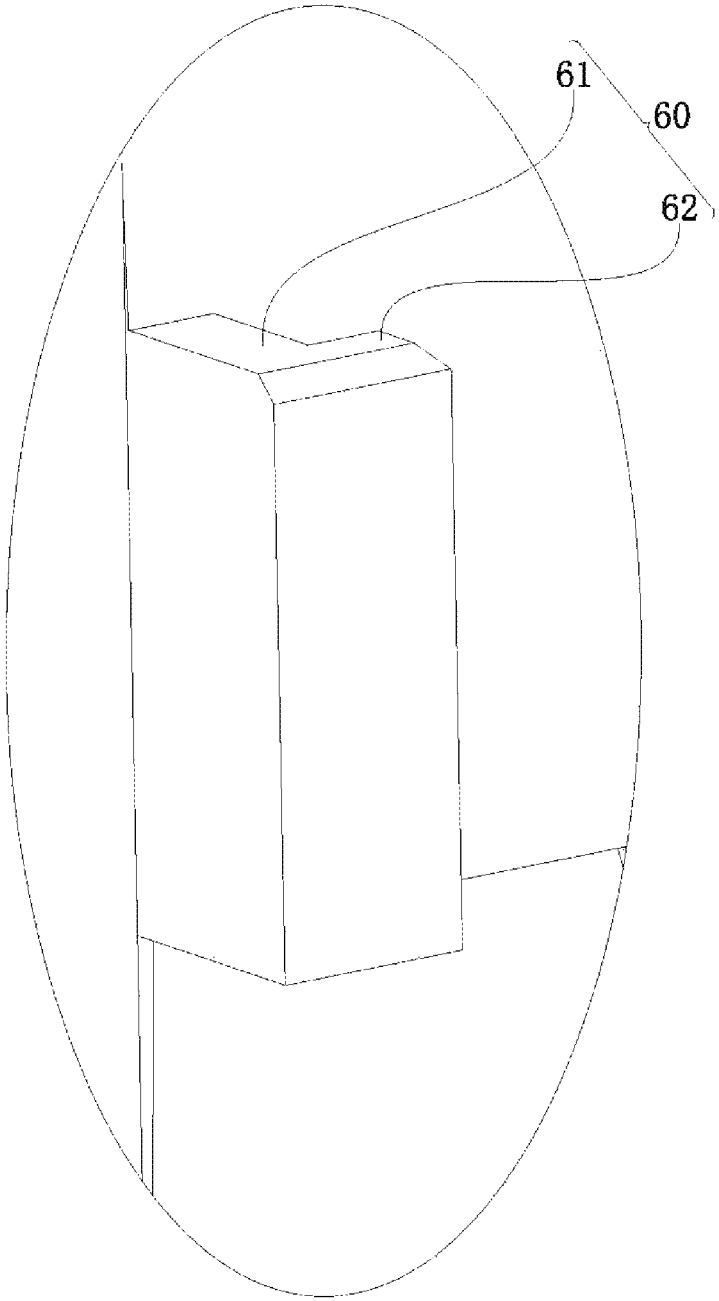
FIG. 5 is an enlarged schematic view of the partial structure shown as "A" in FIG. 4.

As shown in FIGS. 5~6 and 8 according to the present embodiment, the each of said connecting slots 50 comprises a transverse slot segment 51 and a longitudinal slot segment 52 connected to said transverse slot segment 51, the each of said connecting columns 60 comprises a transverse column segment 61 and a longitudinal column segment 62 connected to said transverse column segment 61, said transverse slot segment 51 is fittingly connected with said transverse column segment 61, and said longitudinal slot segment 52 is fittingly connected with said longitudinal column segment 62. Particularly, the connecting slot 50 is an L-shaped structure composed of the transverse slot segment 51 and the longitudinal slot segment 52. Similarly, the connecting columns 60 is an L-shaped structure composed of the transverse column segment 61 and the longitudinal column segment 62. The connecting slot 50 of the L-type structure engages with the connecting columns 60 of the L-shaped structure, and the fitting between the transverse slot segment 51 and the transverse column segment 61 limits the relative sliding of the fitted connecting slot 50 and the connecting columns 60 in the longitudinal direction. Besides, the fitting between the longitudinal slot segment 52 and the longitudinal column segment 62 limits the relative sliding of the fitted connecting slot 50 and the connecting columns 60 in the transverse direction. As a result, the fit connection between the connecting slot 50 and the connecting columns 60 is limited transversely and longitudinally, so that the sliding fit between the connecting slot 50 and the connecting columns 60 can only made in a lengthwise direction of the assembly thereof (vertical direction), which can effectively improve the stability and reliability of the connection between connecting slot 50 and the connecting column 60.

As shown in FIGS. 4-5 and 8 according to the present embodiment, said two longitudinal slot segments 52 are respectively arranged to extend in the opposite direction by the end of said transverse slot segment 51, and said two longitudinal column segments 62 are arranged to extend in the opposite direction by the end of said transverse column segment 61 respectively. Particularly, the two longitudinal column segments 62 are extended toward the position facing the socket 11, so that the arrangement of the longitudinal column segment 62 is prevented from interfering with the insertion of the plug 30 into the socket 11 while the longitudinal column sections 62 is in turn combined with the column segment 61 to form the connecting columns 60 of special-shaped structure, which engages with the connecting slot 50 of special-shaped structure to prevent loosening.

Certainly, in other embodiments, the two longitudinal slot segments 52 are respectively arranged to extend in opposite directions from the ends of the transverse slot segments 51, and the two longitudinal column segments 62 are respectively arranged to extend in opposite directions from the ends of the transverse column segments 61, in this structure, it is necessary to shorten the length of the longitudinal column segment 62 and the longitudinal slot segment 52, so as to prevent the longitudinal column segment 62 from interfering with the insertion of the plug 30 into the socket 11.

As shown in FIGS. 4 and 7~8 according to the present embodiment, the end of said fixing portion 42 are provided with a longitudinal guiding slot 421 extending from the top surface of said fixing portion 42 to the bottom surface of said fixing portion 42, an longitudinal guide rib 12 corresponding to the longitudinal guiding slot 421 for sliding fit with said longitudinal guiding slot 421 is provided on the end of said adapter body 10 located above said socket 11. Particularly, when sliding along the direction in which the connecting slot 50 and the connecting column 60 are engaged with each other, the longitudinal guiding slot 421 provided on the fixing portion 42 of the snap-fitting cover 40 also engages with the longitudinal guide rib 12 provided at the end of the adapter body 10, i.e., the engagement of the longitudinal guiding slot 421 and the longitudinal guide rib 12 serves to guide the sliding of the snap-fitting cover 40 relative to the adapter body 10, which will limit the sliding direction of the snap-fitting cover 40 and thereby effectively ensure the relative sliding between the connecting slot 50 and the connecting columns 60.

Further, as shown in FIGS. 7~8 according to the present embodiment, the bottom of said longitudinal stop slot is provided with a longitudinal stop step 422 for restricting the vertical sliding distance of the longitudinal guide rib 12 relative to said longitudinal guiding slot 421. When the snap-fitting cover 40 is sliding with respect to the adapter body 10 and disengaged, the longitudinal stop step 422 provided at the bottom of the longitudinal stop slot will abut against the longitudinal guide rib 12 to restrict the further sliding of the snap-fitting cover 40 after sliding a certain distance, the connecting slot 50 can be prevented from being completely disengaged from the slide columns 60, that is, the snap-fitting cover 40 is always connected to the adapter body 10.

In the present embodiment, said snap-fitting portion 41 and said fixing portion 42 are integrally injection-molded with ABS plastics. Particularly, ABS plastics are characterized by impact resistance, heat resistance, low temperature resistance, chemicals resistance and excellent electrical performance, as well as easy processing, stable product size, good surface gloss, the snap-fitting cover 40 molded and formed by ABS plastics has perfect structural performance and long service life.

As shown in FIGS. 1~4 according to the present embodiment, the side of said adapter body 10 is provided with an connection block 13, and said connection block 13 is provided with at least one fixing hole for passing through the fasteners 14 (not shown in the figure) to be fixedly connected to the external device. Particularly, the fixing hole 14 is provided on the connection block 13 so that it can be easily fixed to the external device through the fasteners passing through the fixing hole 14, and the adapter body 10 can be protected.

The foregoing is merely illustrative embodiments of the present application and is not intended to limit the invention. Any modifications, equivalent substitutions and improvements within the spirit and principles of the present application should be included within the protection range of the present application.

The invention claimed is:

1. A power adapter, comprising an adapter body and a power cord, one end of said adapter body is provided with a socket, one end of said power cord is provided with a plug, and said plug is plugged in and connected to said socket; wherein said power adapter further comprises a snap-fitting cover, said snap-fitting cover comprises a snap-fitting portion and a fixing portion connected to said snap-fitting portion, said fixing portion is movably connected to said end provided with the socket of the adapter body, said snap-fitting portion is provided with a groove whose one side is open and has a shape matching with a contour of said plug, and said groove is snap-fitted to an outer side of said plug, wherein connecting slots and connecting columns are arranged between said fixing portion and the end provided with a socket of the adapter body; and the end of said fixing portion is provided with a longitudinal guiding slot extending from a top surface of said fixing portion to a bottom surface of said fixing portion, the end of said adapter body located above said socket is provided with a longitudinal guide rib corresponding to the longitudinal guiding slot for sliding fit with said longitudinal guiding slot and a bottom of said longitudinal stop slot is provided with a longitudinal stop step for limiting a vertical sliding distance of said longitudinal guide rib relative to said longitudinal guiding slot, such that the snap-fitting cover can be move towards the longitudinal guide rib without disengagement from the adapter body.

2. The power adapter according to claim 1, wherein said plug comprises a straight portion and a trapezoidal portion provided in a longitudinal direction, said trapezoidal portion is connected with said power cord, said groove comprises a straight groove segment and a trapezoidal groove segment provided in the longitudinal direction, said straight groove segment is snap-fitted to said straight portion, and said trapezoidal groove segment is snap-fitted to said trapezoidal portion.

3. The power adapter according to claim 2, wherein each of the opposite inside walls in a traverse direction of said straight groove segment is provided with an arcuate stop recess, and the opposite outside walls in a traverse direction of said straight portion are limited to the arcuate stop recesses respectively.

4. The power adapter according to claim 3, wherein each of the opposite inside walls in the transverse direction of said straight groove segment is also provided with a stop protrusion positioned between an open edge of said groove and said arcuate stop recess, an inner edge of said stop protrusion abuts against said straight portion.

5. The power adapter according to claim 1, wherein said fixing portion is movably connected to the end of said adapter body through a fit connection between said connecting slots and said connecting columns.

6. The power adapter according to claim 5, wherein said connecting slots are provided in said fixing portion, and said connecting columns are provided at the end of said adapter body; or said connecting slots are provided at the end of said adapter body, and said connecting columns are provided in said fixing portion.

7. The power adapter according to claim 6, wherein said connecting slots are arranged to extend from the bottom surface of said fixing portion toward the top surface of said fixing portion; or said connecting slots are arranged to extend from the bottom surface of said adapter body to the top surface of said adapter body.

8. The power adapter according to claim 5, wherein said connecting slots and said connecting columns are both arranged in the vertical direction.

9. The power adapter according to claim 5, wherein both a number of said connecting slots and a number of said connecting columns are respectively two, and the fitted two connecting slots and two connecting columns are respectively located on both sides of said socket.

10. The power adapter according to claim 9, wherein each said connecting slot comprises a transverse slot segment and a longitudinal slot segment connected to said transverse slot segment, a said connecting column comprises a transverse column segment and a longitudinal column segment connected to said transverse column segment, said transverse slot segment is fittingly connected with said transverse column segment, and said longitudinal slot segment is fittingly connected with said longitudinal column segment.

11. The power adapter according to claim 10, wherein said two longitudinal slot segments are respectively arranged to extend in the opposite directions from ends of said two transverse slot segments, and said two longitudinal column segments are respectively arranged to extend in the opposite directions from ends of said two transverse column segments.

12. The power adapter according to claim 1, wherein said snap-fitting portion and said fixing portion are integrally injection-molded with ABS plastics.

13. The power adapter according to claim 1, wherein the side of said adapter body is provided with a connection block which is provided with at least one fixing hole for passing through fasteners to be fixedly connected to an external device.

* * * * *